United States Patent [19]

Neamtu

[11] Patent Number: 5,010,646

[45] Date of Patent: Apr. 30, 1991

[54] SHAVING SYSTEM

[75] Inventor: Nicolae Neamtu, Quincy, Mass.

[73] Assignee: The Gillette Company, Boston, Mass.

[21] Appl. No.: 471,099

[22] Filed: Jan. 26, 1990

[51] Int. Cl.[5] ..... B26B 21/00; B26B 19/44; B26B 19/12

[52] U.S. Cl. ..... 30/50; 30/41; 30/43.9

[58] Field of Search ..... 30/41, 42, 43.9, 48, 30/49, 50, 52, 57, 58, 78

[56] References Cited

U.S. PATENT DOCUMENTS

| | | | |
|---|---|---|---|
| 4,302,876 | 12/1981 | Emmett . | |
| 4,378,634 | 4/1983 | Jacobson . | |
| 4,498,235 | 2/1985 | Jacobson . | |
| 4,551,916 | 11/1985 | Jacobson | 30/50 |
| 4,586,255 | 5/1986 | Jacobson | 30/50 |
| 4,589,205 | 5/1986 | Tanahashi | 30/43.9 |
| 4,603,477 | 8/1986 | Francis | 30/50 |
| 4,621,424 | 11/1986 | Jacobson | 30/50 |
| 4,782,590 | 11/1988 | Pope | 30/50 |
| 4,893,641 | 1/1990 | Strickland | 30/41 |

*Primary Examiner*—Douglas D. Watts
*Assistant Examiner*—Paul M. Heyrana, Sr.
*Attorney, Agent, or Firm*—Fish & Richardson

[57] ABSTRACT

A razor blade member has a first planar portion and a second planar portion connected to the first planar portion by a transition bend region. The longitudinal edge of the first planar portion remote from the transition region is sharpened to a cutting edge. The blade member also includes stress balancing deformation along the longitudinal length of the planar portions and adjacent the transition region. The bow of the second planar portion is less than 0.05 millimeter per centimeter length of blade member.

20 Claims, 2 Drawing Sheets

SHAVING SYSTEM

This invention relates to wet shaving systems, and more particularly to razor blade assemblies for such systems.

Razor blade assemblies in which the blade shaving edge is movable in response to forces encountered during shaving have been proposed. Examples of such razor blade assemblies are shown in U.S. Pat. No. 4,498,235. In shaving systems disclosed in that patent, guard and blade members are independently movable in response to shaving forces, and each blade member has a base portion and a cutting edge portion disposed at an angle to the base portion. When such blade members are formed by bending a single piece of metal and the base and cutting edge portions are connected by a bend transition region, longitudinal distortion is produced which results in longitudinal curvature in the base portion and similar longitudinal curvature in the sharpened edge. Such longitudinal curvatures ("bow") are undesirable, from a standpoint of shaving geometry, and from the standpoint of reliable movement in response to forces encountered during shaving and return to the initial position when the shaving force is released.

In accordance with one aspect of the invention, there is provided a razor blade member that has a first planar portion and a second planar portion connected to the first planar portion by a transition bend region, and the longitudinal edge of the first planar portion remote from the transition region being sharpened to a cutting edge. The blade member also includes stress balancing deformation along the longitudinal length of the planar portions and adjacent the transition region. The bow of the second planar portion is less than 0.05 millimeter per centimeter length of blade member.

While the stress balancing deformation may take a variety of forms, in preferred embodiments, that deformation is in the form of corrugations in the two planar portions and do not extend through the transition bend region, the corrugations in the first planar portion extending the length of that portion and the corrugations in the second planar portion terminating about halfway along the length of that portion. In a particular embodiment, the corrugations are of undulating configuration and are equally spaced along the length of the blade member with adjacent peaks less than two millimeters apart, and the dimension between opposing peaks of the undulating corrugations being less than about 0.2 millimeter.

In a particular embodiment, the first planar portion is disposed at an angle of less than 135 degrees with respect to the second planar portion; the transition region between the first and second blade portions has a radius of less than one millimeter; the blade member is a steel member that has a carbon content of about 0.4 percent by weight, a chromium content of about 13 percent by weight, and a hardness greater than about 100 VON (Vickers Ocular Number), In accordance with another aspect of the invention, there is provided a razor blade assembly that includes a body member; a blade member disposed in the body member, the blade member having a first planar portion and a second planar portion connected to the first planar portion by a transition bend region, the longitudinal edge of the first planar portion remote from the transition region being sharpened to a cutting edge, and stress balancing deformation along the longitudinal length o the planar portions and adjacent the transition region; structure in the body member for supporting the blade member for movement relative to the body member in response to forces encountered during shaving in a direction along the plane of the second planar portion; and biasing structure in the body member for urging the cutting edge of the blade member into a reference position from which it is moved in response to forces encountered during shaving. The bow of the cutting edge is less than 0.05 millimeter per centimeter length of blade member.

In preferred embodiments, the body member is a one-piece molded member; the support structure includes upstanding projections integral with the body member that receive and guide the first planar portion of the blade member; and the biasing structure includes spring finger structure integral with the body member. In a particular embodiment, the assembly includes a second blade member and a guard member, and the two blade members and the guard members are resiliently mounted for movement independently of one another relative to the body member in response to forces encountered during shaving.

Other features and advantages of the invention will be seen as the following description of a particular embodiment progresses in conjunction with the drawings in which.

DESCRIPTION OF PARTICULAR EMBODIMENT

Figure 1:
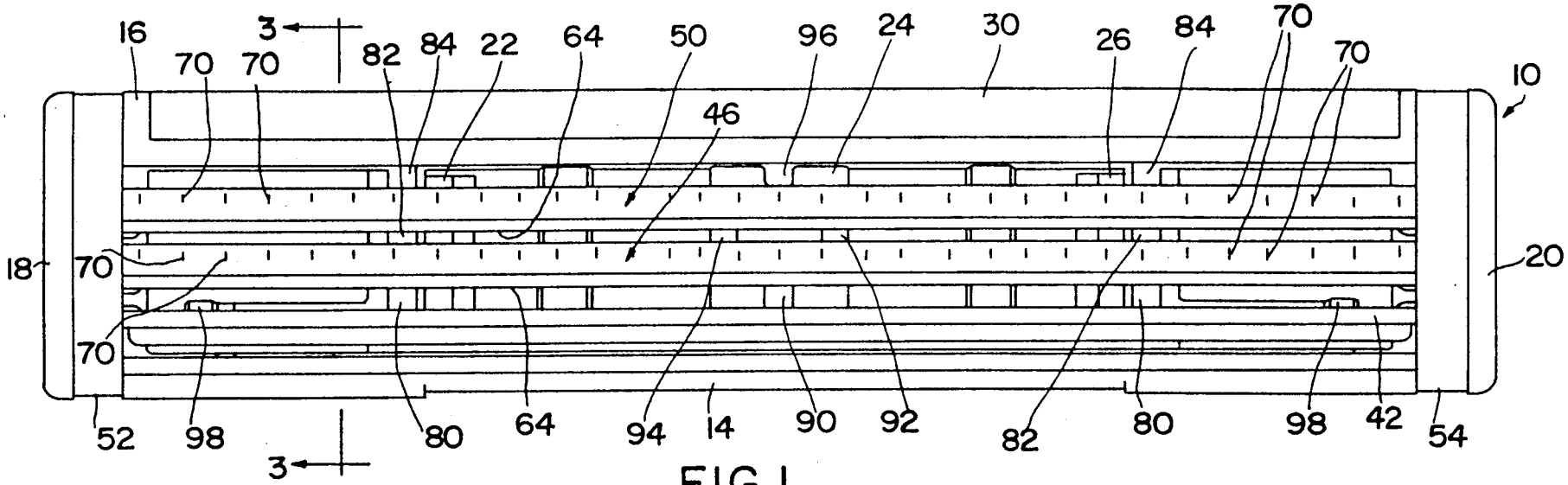
FIG. 1 is a plan view of a razor blade assembly in accordance with the invention.
Figure 2:
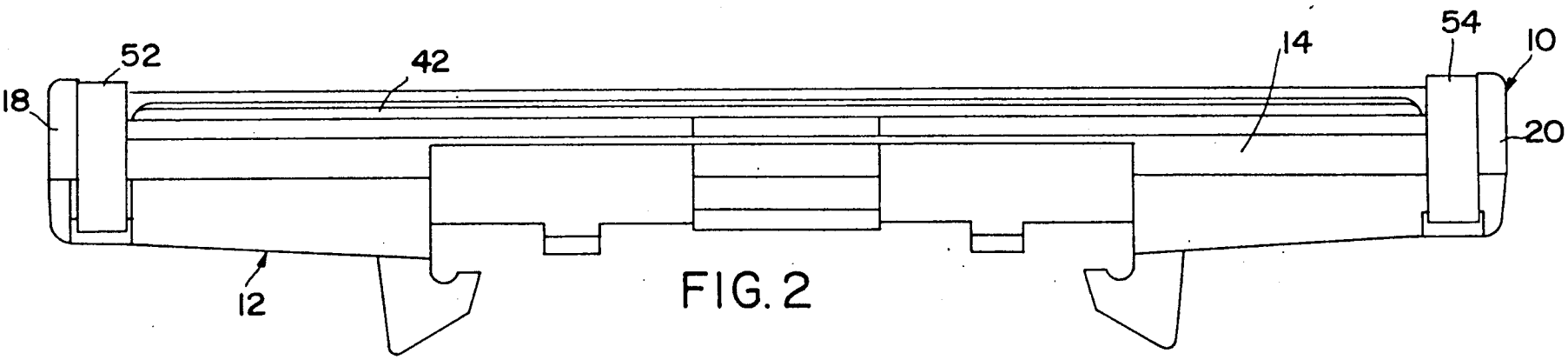
FIG. 2 is a front elevational view of the razor assembly shown in FIG. 1.
Figure 3:
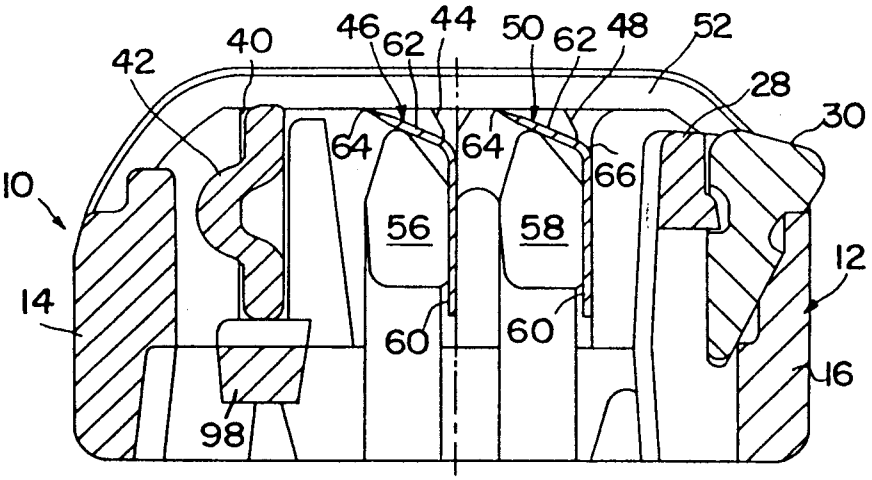
FIG. 3 is a sectional view taken along the line 3—3 of FIG. 1.

With reference to FIGS. 1–3, blade assembly 10 includes molded plastic body member 12 with front and back wall portions 14, 16 that are interconnected by end wall portions 18, 20 and intermediate frame portions 22, 24 and 26. Back wall portion 16 includes surface 28 that functions as a trailing skin engaging or "cap" surface and receives an insert member 30 of shave facilitating material.

As indicated in FIG. 3, formed in each end wall portion is a leading slot 40 that receives guard member 42; an intermediate slot 44 that receives first blade member 46 and a trailing slot 48 that receives second blade member 50. Retaining bands 52, 54 on end walls 18, 26 secure members 42, 46 and 50 in slots 40, 44 and 48, respectively. Also formed integrally with each end wall are inwardly extending spring fingers 56, 58 that bias blades 46, 50 upwardly into an initial or reference position in engagement with retaining bands 52, 54. Further details of a razor assembly of this type may be had with reference to Jacobson U.S. Pat. No. 4,498,235.

Figure 5:
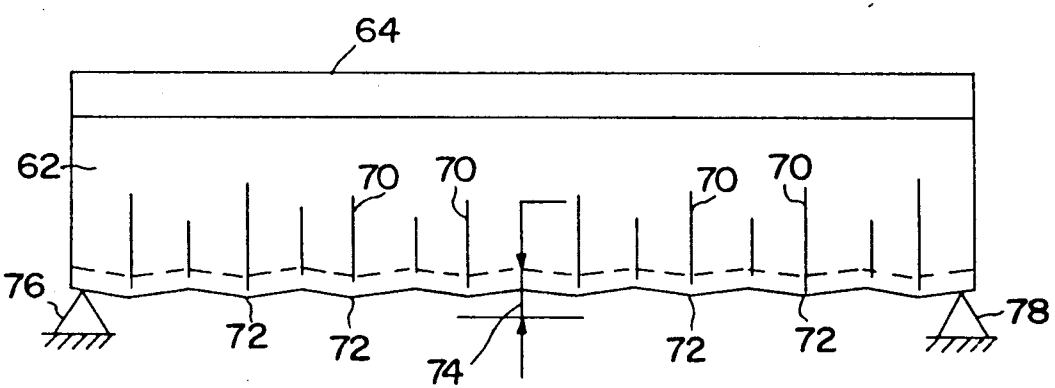
FIG. 5 is a diagrammatic top plan view of the blade member shown in FIG. 4.
Figure 4:
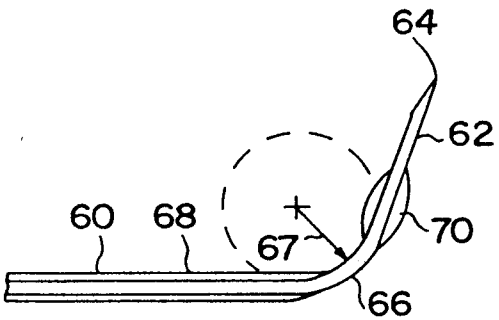
FIG. 4 is an enlarged side sectional diagrammatic view of a blade member employed in the razor assembly of FIG. 1.

With reference to FIGS. 4 and 5, each blade member 46, 50 is manufactured of 0.1 millimeter thick stainless steel of the following composition:

| | Percent |
|---|---|
| Carbon | 0.47–0.44 |

-continued

| | Percent |
|---|---|
| Chromium | 13.0–14.0 |
| Manganese | 0.20–0.50 |
| Silicon | 0.20–0.50 |
| Molybdenum | 1.15–1.35 |

the balance being essentially iron, the blade member having an hardness of about 98 VON. Each blade is about 3.5 centimeters long and has a planar base or guide portion 60 that is about 0.2 centimeter long and a planar second portion 62 that is about 0.1 centimeter long and is disposed at an angle of about 112° to guide portion 60. Portion 62 has sharpened longitudinal edge 64 and is connected to base portion 60 by transition bend region 66 that has a radius 67 of about 0.4 millimeter. Formed in portions 60, 62 adjacent to but not extending through transition region 66 are a series of corrugations 68, 70 that have aligned peaks 72 spaced about one millimeter apart along the longitudinal length of both the base portion 60 and the second portion 62. Corrugations 68 extend the length of base portion 60 while corrugations 70 extend only about halfway along the length of portion 62, as indicated diagrammatically in FIG. 4. Corrugations 68, 70 distribute and balance stresses formed by the bending of the blade stock at the sixty-eight degree bend angle in transition region 66 such that the guide portion 60 is essentially straight (the "bow" 74 being less than 0.03 millimeter over the 3.5 centimeter length of the blade—as indicated by triangles 76, 78). In contrast, a blade with no corrugations or other stress balancing deformation has a bow of about 0.1 millimeter over the 3.5 centimeter blade length.

With reference again to FIGS. 1–3, formed on intermediate frame portions 22 and 26 are a series of upstanding projections 80, 82, 84, the front surface of each projection 82 providing a vertical guide surface against which the base portion 60 of blade 46 slides and the front surface of each projection 84 providing a similar guide surface against which the base portion of trailing blade 50 slides. Similar projections 90, 92, 94 and 96 are upstanding from intermediate frame portion 24. The rear surface of projection 90 cooperates with the front surfaces of projections 92 and 94 to define a guidance region for the base portion 60 of leading blade 46; and rear surfaces of projections 92 and 94 cooperate with the front surface of projection 96 to provide a central guidance region for the base portion of trailing blade 50.

Spring fingers 98, that are molded integrally with intermediate frame portions 24 and 26 and extend outwardly in opposite directions, engage the lower surface of guard member 42 and bias that guard member upwardly against the retaining bands 52, 54 in position indicated in FIG. 3.

Similarly, the blades 46, 50 with stress balancing corrugations 68, 70 are received in the guide passages defined by the upstanding projections 80–84 and 90–96; are biased upwardly against the retaining bands 52, 54 in position indicated in FIG. 3 by spring fingers 56 and 58; and slide freely against the upward biasing influence of those spring fingers in response to forces encountered during shaving.

During a shaving operation, the second blade 50 trails the first blade 46 as the assembly travels over the surface being shaved, and the guard 42 and blades 46, 50 move independently of each other against the bias of the spring fingers.

While a particular embodiment of the invention has been shown and described, various modification will be apparent to those skilled in the art, and therefore it is not intended that the invention be limited to the disclosed embodiment, or to details thereof, and departures may be made therefrom within the spirit and scope of the invention.

What is claimed is:

1. A razor blade member that has a first planar portion and a second planar portion, said second planar portion being angularly offset from said first planar portion and connected to said first planar portion by a transition region, the longitudinal edge of said first planar portion remote from said transition region being a cutting edge, and stress balancing deformation along the longitudinal length of said planar portions and adjacent said transition region.

2. The blade member as claimed in claim 1 wherein said blade member is a metal member.

3. The blade member of claim 1 wherein said transition region between said first and second blade portions has a radius of less than one millimeter.

4. The blade member of claim 1 wherein said first planar portion is disposed at an angle of less than 135 degrees with respect to said second planar portion.

5. The blade member of claim 1 wherein the said second planar portion has bow of less than 0.05 millimeter per centimeter length of blade member.

6. The blade member of claim 1 wherein said stress deformation adjacent said transition region is in the form of corrugations.

7. The blade member of claim 6 wherein said corrugations are of undulating configuration and said corrugations are spaced less than two millimeters apart, the dimension between opposing peaks of said undulating corrugations being less than about 0.2 millimeter.

8. The blade member of claim 6 wherein said corrugations are equally spaced along the length of said blade member.

9. The blade member of claim 6 wherein said blade member is a metal member, said first planar portion is disposed at an angle of less than 135 degrees with respect to said second planar portion, and said transition region between said first and second blade portions has a radius of less than one millimeter.

10. The blade member of claim 9 wherein said blade member has a thickness of less than 0.3 millimeter, and said second planar portion has bow of less than 0.05 millimeter per centimeter length of blade member.

11. The blade member of claim 10 wherein said blade member is a steel member that has a carbon content of about 0.4 percent by weight and a chromium content of about 13 percent by weight and a molybdenum content of about 1.25 percent by weight.

12. A razor blade assembly comprising a body member; a blade member disposed in said body member, said blade member having a first planar portion and a second planar portion, said second planar portion being angularly offset from said first planar portion and connected to said first planar portion by a transition bend region, the longitudinal edge of said first planar portion remote from said transition region being a cutting edge, and stress balancing deformation along the longitudinal length of said planar portions and adjacent said transition region; structure in said body member for supporting said blade member for movement relative to said body member in response to forces encountered during shaving in a direction along the plane of the second planar portion; and biasing structure in said body member for urging said cutting edge of said blade member into a reference position from which it is moved in response to forces encountered during shaving.

13. The assembly of claim 12 wherein said body member is a one piece molded member; said support structure includes upstanding projections integral with said body member that receive and guide said first planar portion of said blade member; and said biasing structure includes spring finger structure integral with said body member.

14. The assembly of claim 13 wherein said assembly includes a guard member resiliently mounted for movement independently of said blade member relative to said body member in response to forces encountered during shaving; and a second blade member resiliently mounted for movement independently of said blade member relative to said body member in response to forces encountered during shaving, said second blade member having a first planar portion and a second planar portion connected to said first planar portion by a transition bend region, the longitudinal edge of said first planar portion remote from said transition region being sharpened to a cutting edge, and stress balancing deformation along the longitudinal length of said planar portions and adjacent said transition region.

15. The assembly of claim 12 wherein said cutting edge has bow of less than 0.05 millimeter per centimeter length of blade member.

16. The assembly of claim 12 wherein said stress deformation adjacent said transition region is in the form of corrugations.

17. The assembly of claim 16 wherein said blade member has a thickness of less than 0.3 millimeter, said second planar portion has bow of less than 0.05 millimeter per centimeter length of blade member, said corrugations are of undulating configuration and are spaced less than two millimeters apart, and the dimension between opposing peaks of said undulating corrugations is less than about 0.2 millimeter.

18. The assembly of claim 17 wherein said corrugations are equally spaced along the length of said blade member.

19. The assembly of claim 18 wherein said blade member is a steel member that has a carbon content of about 0.4 percent by weight, a chromium content of about 13 percent by weight, a molybdenum content of about 1.25 percent by weight, and a hardness of at least about 100 VON; said first planar portion is disposed at an angle of about 112 degrees with respect to said second planar portion; and said transition region between said first and second planar portions has a radius of less than one millimeter.

20. The assembly of claim 19 wherein said blade member has a thickness of about 0.1 millimeter, and said second planar portion has bow of less than 0.05 millimeter per centimeter length of blade member.

* * * * *